US006284096B1

(12) United States Patent
Hartmann

(10) Patent No.: US 6,284,096 B1
(45) Date of Patent: Sep. 4, 2001

(54) PROCESS FOR DISCHARGING IMPURITIES FROM A HYDROCYCLONE AND A HYDROCYCLONE

(75) Inventor: Rolf Hartmann, Weingarten (DE)

(73) Assignee: Voith Sulzer Papiertechnik Patent GmbH, Ravensburg (DE)

( * ) Notice: Subject to any disclaimer, the term of this patent is extended or adjusted under 35 U.S.C. 154(b) by 0 days.

(21) Appl. No.: 09/610,616

(22) Filed: Jul. 5, 2000

(30) Foreign Application Priority Data

Jul. 6, 1999 (DE) ..... 199 31 166
Mar. 7, 2000 (DE) ..... 200 04 255

(51) Int. Cl.[7] ..... D21C 9/08; D21H 23/00; B04C 5/18

(52) U.S. Cl. ..... 162/55; 162/380; 209/731

(58) Field of Search ..... 162/4, 5, 55, 189, 162/190, 380, 60; 209/170, 725, 727, 729, 730, 731; 210/512.1, 512.2

(56) References Cited

U.S. PATENT DOCUMENTS 3,720,315 * 3/1973 Kaiser ..... 209/728
3,764,006 * 10/1973 Wikdahl ..... 209/729
3,785,489 * 1/1974 Frykhult ..... 209/731
4,151,083 * 4/1979 Dove ..... 210/84
4,356,084 * 10/1982 Hatton et al. ..... 209/731
4,443,331 * 4/1984 Julien Saint Amand ..... 209/210
5,069,751 * 12/1991 Chamblee et al. ..... 162/5
6,109,451 * 8/2000 Grimes ..... 209/725

FOREIGN PATENT DOCUMENTS 1 138 378 12/1982 (CA) ..... B04C/5/00

* cited by examiner

*Primary Examiner*—Peter Chin
*Assistant Examiner*—Eric Hug
(74) *Attorney, Agent, or Firm*—Greenblum & Bernstein, P.L.C.

(57) ABSTRACT

A hydrocyclone and a process for discharging impurities from a suspension containing paper fibers using a hydrocyclone having a radially inner area. The hydrocyclone includes an inflow for introducing the suspension to be purified, an accepted stock outflow for discharging the purified suspension, a separating part, a reject discharge device for discharging impurities of the suspension, at least one element for adding a diluting liquid at an addition point which is located in a radially inner area of the hydrocyclone, wherein the at least one element has at least one aperture opening axially and opposite to a discharge direction of the impurities. The process includes adding a diluting liquid into the suspension in the radially inner area of the hydrocyclone, wherein the diluting liquid is added in a flow direction opposite to an axial discharge direction of the impurities.

40 Claims, 4 Drawing Sheets

PROCESS FOR DISCHARGING IMPURITIES FROM A HYDROCYCLONE AND A HYDROCYCLONE

CROSS-REFERENCE TO RELATED APPLICATIONS

The present application claims priority under 35 U.S.C. §119 of German Patent Application No. 199 31 166.8, filed on Jul. 6, 1999 and German Patent Application No. 200 04 255.6, filed on Mar. 7, 2000, the disclosure of which is expressly incorporated by reference herein in its entirety.

BACKGROUND OF THE INVENTION

1. Field of the Invention

The invention relates to a process for discharging impurities from a suspension containing paper fibers using a hydrocyclone in which diluting liquid is added into the suspension in the radially inner area of the hydrocyclone. The invention also relates to a hydrocyclone for carrying out the process.

2. Discussion of Background Information

As is known, hydrocyclones are well suited to concentrating the heavy parts and/or the light parts of a pulp suspension. Such devices typically utilize centrifugal forces in order to conduct such parts out of the hydrocyclone through a discharge aperture provided for this purpose. As a rule, hydrocyclones also serve to remove impurities such as small metal parts, glass slivers, sand, styropor, as well as light plastics. Moreover, it is important for such devices to achieve a high separating effect with increased operational reliability, e.g., freedom from clogging. In these known devices, clogs can occur when the impurities collect together and become concentrated in specific locations, e.g., in the area of the discharge aperture provided for them. These concentrations can accumulate over time in such a way that they result in a blockage. In many cases, a compromise must be found between the operational reliability of the device, e.g., the avoidance of clogs, and the highest possible efficiency of the machine, e.g., throughput and/or separating effect. One known method which attempts to address the problem of clogging utilizes the feeding in a diluting liquid in heavy-part hydrocyclones. Such a device utilizes a water feed line which opens in an edge area of the hydrocyclone, e.g., through slits in the cyclone wall in the peripheral direction. The diluting liquid acts to cause eddies at the edge layers. However, this design suffers from the fact that the diluted liquid must penetrate the heavy soil that is already concentrated therein, which can lead to a back washing of heavy parts into the accepted stock stream.

Other solutions utilize a central pipe having apertures facing radially outwards for adding the diluting liquid. For example, Canadian Patent Application No. 1 138 378 A describes a device wherein the diluting liquid quickly reaches the wall of the hydrocyclone with the detrimental effects already described. In such a design, undesired rebound effects can arise owing to the short distance and the flow of the diluting liquid directly onto the cyclone wall. Moreover, there is also an increased risk of clogging of the apertures, which are kept relatively small. In addition, the suggested swirl flow leads to further interfering eddies.

A known design is described in U.S. Pat. No. 3,785,489. This device utilizes an axial outflow. However, the design also produces a rotating flow at the central inflow of the diluting water by way of a number of vanes. Accordingly, this flow quickly drives the diluting water outwards. The effect of this flow is also an increased risk of clogging.

SUMMARY OF THE INVENTION

The invention is therefore directed to a process for discharging impurities from hydrocyclones which enables both an operationally more reliable removal of the impurities and a good separating effect.

According to the invention, the diluting liquid is introduced approximately centrally and in an axial direction rather than at the edge of the hydrocyclone, where clogging can be expected. Moreover, this design provides for the introduction of the diluting fluid predominantly into the core flow. Accordingly, if the rate of inflow is sufficiently high, the diluting liquid reaches the conical area of the separating chamber and gradually mixes with the surrounding pulp suspension owing to the effect of the shear flow prevailing there. This type of dilution leads to a gentle backwash of the fibers into the accepted stock, but without this happening to already concentrated heavy parts as well. The reason being that the latter are at the wall and are not affected by the addition of the diluting water. Without the measures of the invention, a portion of the already concentrated heavy parts could be stirred up and might reach the center of the hydrocyclone. From there, they would then disadvantageously be discharged with the accepted stock.

The invention provides for a process for discharging impurities from a suspension containing paper fibers using a hydrocyclone comprising a radially inner area, the process comprising adding a diluting liquid into the suspension in the radially inner area of the hydrocyclone, wherein the diluting liquid is added in a flow direction opposite to an axial discharge direction of the impurities. The hydrocyclone may comprise a separating cone having a narrowest point and an addition point wherein the diluting liquid is added. The addition point may be axially displaced from the narrowest point by a distance "a". The distance "a" may comprise an axial length which is no greater than approximately 30% of an axial length of the hydrocyclone. The adding may comprise adding a flow of the diluting liquid without swirl. The adding may comprise adding a flow of the diluting liquid with only a swirl whose resulting flow rate vector is defined by a peripheral speed (Vu) and axial speed (Vax) at an edge of a jet, the resulting flow rate vector having an angle ($\alpha$) relative to an axial axis of no greater than approximately 30°. The adding may comprise adding the diluting liquid via a smooth jet. The adding may comprise adding the diluting liquid via a round jet. The adding may comprise adding the diluting liquid via a ring-shaped jet. The adding may comprise adding the diluting liquid into a center portion of the radially inner area with the aid of an injector, the injector drawing in liquid from a ring-shaped area around an addition point. The adding may comprise adding the diluting liquid at an axial speed of at least approximately 4 m/s.

The process may further comprise forming a light fraction from the suspension containing paper fibers, the light fraction comprising an accepted stock. The process may further comprise separating out a heavy fraction from the suspension, the heavy fraction comprising heavy parts.

The invention also provides for a hydrocyclone for discharging impurities from a suspension containing paper fibers, the hydrocyclone comprising an inflow for introducing the suspension to be purified, an accepted stock outflow for discharging the purified suspension, a separating part, a reject discharge device for discharging impurities of the suspension, at least one element for adding a diluting liquid at an addition point which is located in a radially inner area of the hydrocyclone, wherein the at least one element has at least one aperture opening axially and opposite to a discharge direction of the impurities. The reject discharge device may be directly attached to the separating part. The reject discharge device may be indirectly attached to the separating part. The addition point may be located away from the inflow at a point which is at least approximately 70% of an axial length of the hydrocyclone. The the separating part may comprise a separating cone. The addition point may be disposed on part of a flow insert which is located inside the hydrocyclone. The flow insert may be removable. The hydrocyclone may be adapted to accept different flow inserts having different flow actions. The at least one aperture may comprise an adjustable cross section. The position of the at least one aperture may be adjustable. The addition point may be arranged to be concentric with respect to a center of the hydrocyclone. The addition point may be arranged to be eccentric with respect to a center of the hydrocyclone. The addition point may be located at a distance from an inside wall of the hydrocyclone, the distance being at least approximately 10% of an adjacent inside diameter of the hydrocyclone. The addition point may comprise a mouth end of an inflow pipe which is introduced into the hydrocyclone at a position which is below a narrowest cross section portion of the separating part.

Other exemplary embodiments and advantages of the present invention may be ascertained by reviewing the present disclosure and the accompanying drawings.

BRIEF DESCRIPTION OF THE DRAWINGS

The present invention is further described in the detailed description which follows, in reference to the noted plurality of drawings by way of non-limiting examples of exemplary embodiments of the present invention, in which like reference numerals represent similar parts throughout the several views of the drawings, and wherein.

DETAILED DESCRIPTION OF THE PRESENT INVENTION

The particulars shown herein are by way of example and for purposes of illustrative discussion of the embodiments of the present invention only and are presented in the cause of providing what is believed to be the most useful and readily understood description of the principles and conceptual aspects of the present invention. In this regard, no attempt is made to show structural details of the present invention in more detail than is necessary for the fundamental understanding of the present invention, the description taken with the drawings making apparent to those skilled in the art how the several forms of the present invention may be embodied in practice.

Figure 1:
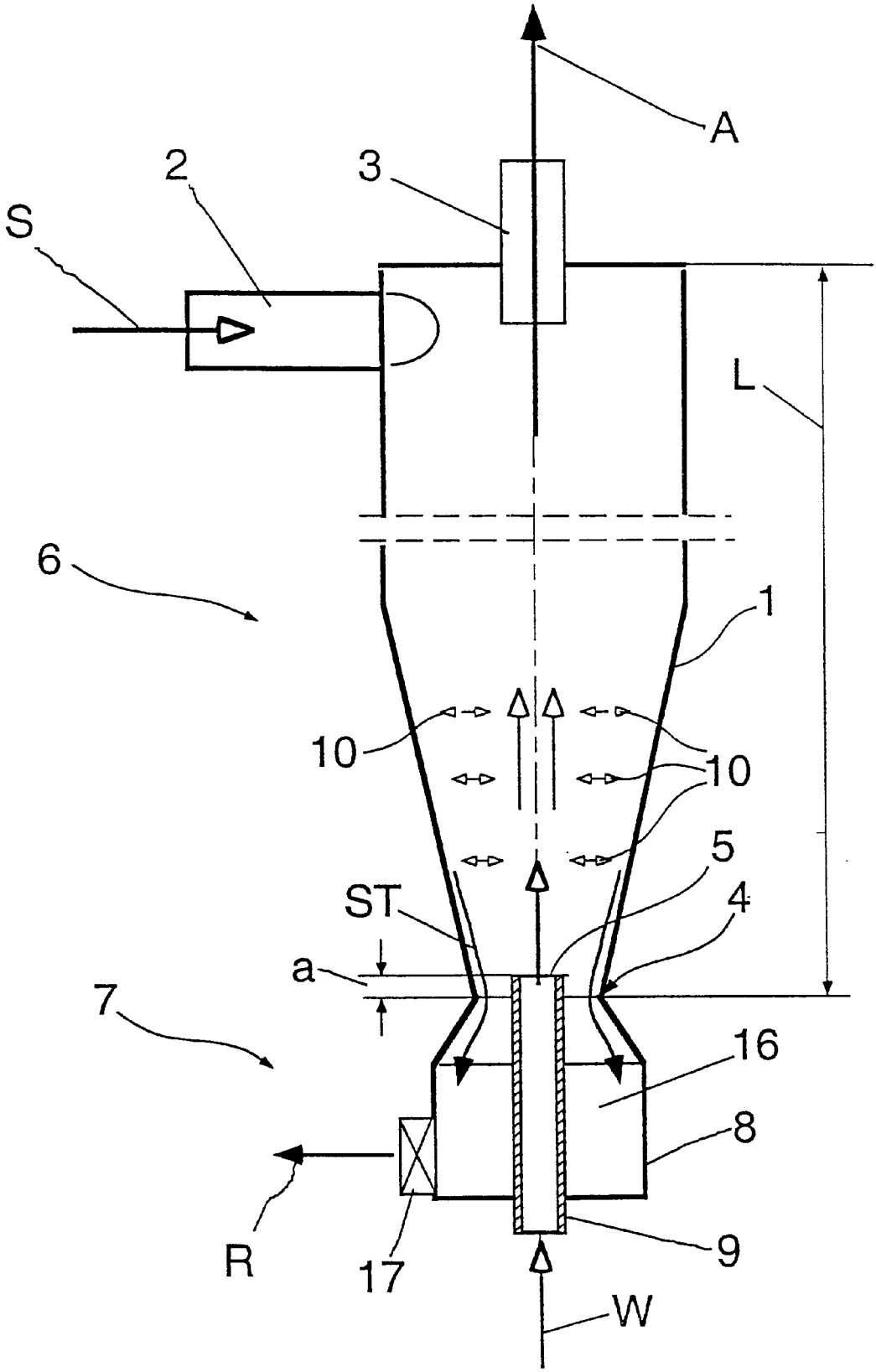
FIG. 1 shows the process being carried out based on a heavy part hydrocyclone in side view, in section.

FIG. 1 shows a rough schematic of a hydrocyclone according to the invention. The hydrocyclone utilizes an inflow 2 for introducing a suspension S containing paper fibers and an accepted stock outflow 3 for discharging a purified suspension, i.e., an accepted stock A. Suspension S, which is to be purified, is subjected to rotation and eventually reaches separating part 6. Separating part 6 utilizes a separating cone 1, in which as a rule, the speed of rotation is again increased. This design causes the contained heavy parts ST to be concentrated at the inside wall of separating cone 1 so that they travel downwards along the wall into a reject discharge device 17.

According to the invention, a diluting liquid W is introduced into a radially inner area of the hydrocyclone via an axial direction. Here, an addition point 5 is located at a distance "a" from a narrowest point 4 of separating cone 1. Distance "a" is preferably approximately a few millimeters at most. In some specific embodiments, distance "a" can be up to approximately 30% of the length L of the hydrocyclone. Another embodiment may require that the axial distance from inflow 2 be kept as long as possible, e.g., at least approximately 70% of the length L of the hydrocyclone.

After heavy parts ST have passed narrowest point 4 of separating cone 1, they fall into a discharge chamber 8, from which they are removed as rejects R, e.g., via discharge device 17. Accordingly, it should be noted that this discharging can be performed continuously or in an intermittent manner.

Figure 5:
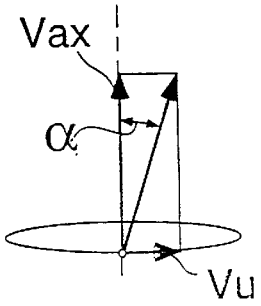
FIG. 5 shows a vector diagram of specific speeds at the edge of the jet of the diluting liquid.

In the example shown here, diluting liquid W is added through a simple vertical inflow pipe 9, which at addition point 5 has an aperture which opens axially and opposite to the discharge direction of heavy parts or impurities ST. This figure also shows schematically that added liquid W predominantly reaches the central core flow of the hydrocyclone. Moreover, it is important that the falling impurities ST can fall into discharge chamber 8 in as undisturbed manner as possible, e.g., without being subjected to eddies, etc. On the other hand, the addition of liquid W enables an undesired concentration of the heavy fraction to be completely prevented, since a partial dilution is also possible in the outer areas of separating cone 1. However, the diluting effect and the associated cross flows produced by this design, e.g., eddies, etc., weaken successively towards the cone wall, so that an impairment of the separating effect does not become significant. These processes are indicated by the broken arrows 10. Moreover, if, in specific cases, a slight rotation of the exiting diluting water stream cannot be avoided, its peripheral component Vu (see FIG. 5) would need to be kept so low in comparison with an axial speed Vax, that the angle $\alpha$ between the resultant of the two vectors and the axis is not greater than 30°. Overall, utilizing this method of adding the diluting water, the mixing is distributed over a considerably larger volume and is thus less detrimental to the separating effect.

The invention advantageously provides for Liquid W to be introduced into the hydrocyclone at a certain axial position. Accordingly, only one aperture need be present at addition point 5. Moreover, if necessary, the position of addition point 5 can be adjusted in the axial direction. Accordingly, this position and/or adjustment can be determined empirically or made to be continuously adjustable.

Figure 2:
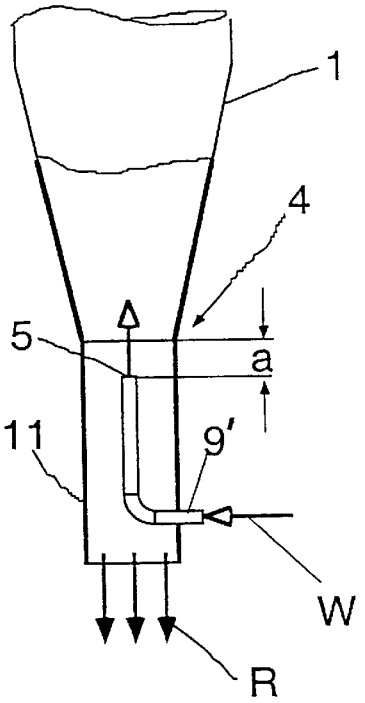
FIGS. 2–4 show variants for the addition of the diluting liquid.

FIG. 2 shows another embodiment of a device for carrying out the process. In this variant, diluting liquid W is introduced via a bent inflow pipe 9' directly into the center of an adjacent rejects pipe 11 which is below separating cone 1. Here, the position, i.e., distance "a", of addition point 5 is selected such that it lies below narrowest point 4. However, the position of addition point 5 may also be located in other locations relative to narrowest point 4, e.g., such as is shown in FIG. 1.

Figure 3:
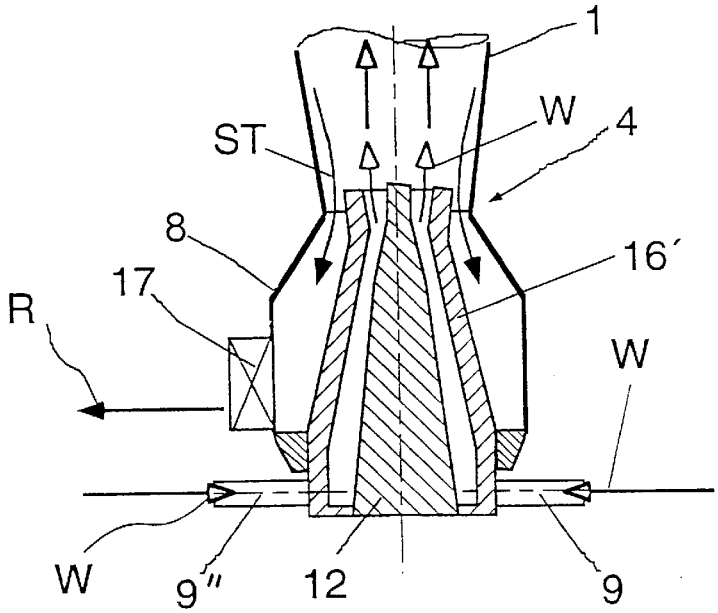

FIG. 3 shows another possible design for carrying out the process. Here, diluting liquid W is first fed into a flow insert 16' in whose interior utilizes a central displacement body 12, so that a ring-shaped flow cross section is formed. A ring-shaped jet is formed which advances slightly into the part of separating cone 1 lying above it. The downward pointing arrows here again show how the heavy parts ST slide downwards in the vicinity of the wall of the hydrocyclone and into discharge chamber 8. It should be noted that this design may provide that they can do so without being washed into the core flow of the hydrocyclone by the stream of diluting liquid W.

Figure 4:
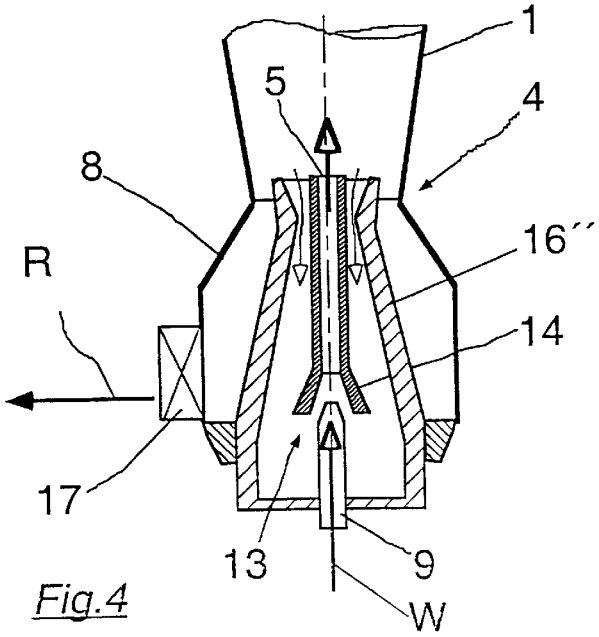

The embodiment according to FIG. 4 shows an axial inflow of diluting liquid W through central inflow pipe 9. Moreover, it opens into a central pipe 14 located inside flow insert 16" via an injector 13. According to this design, parts of the suspension can be sucked out from the hydrocyclone by these mechanism and be added back into the center. This design may serve to ensure a stable mode of operation and minimizes fiber loss.

Figure 6:
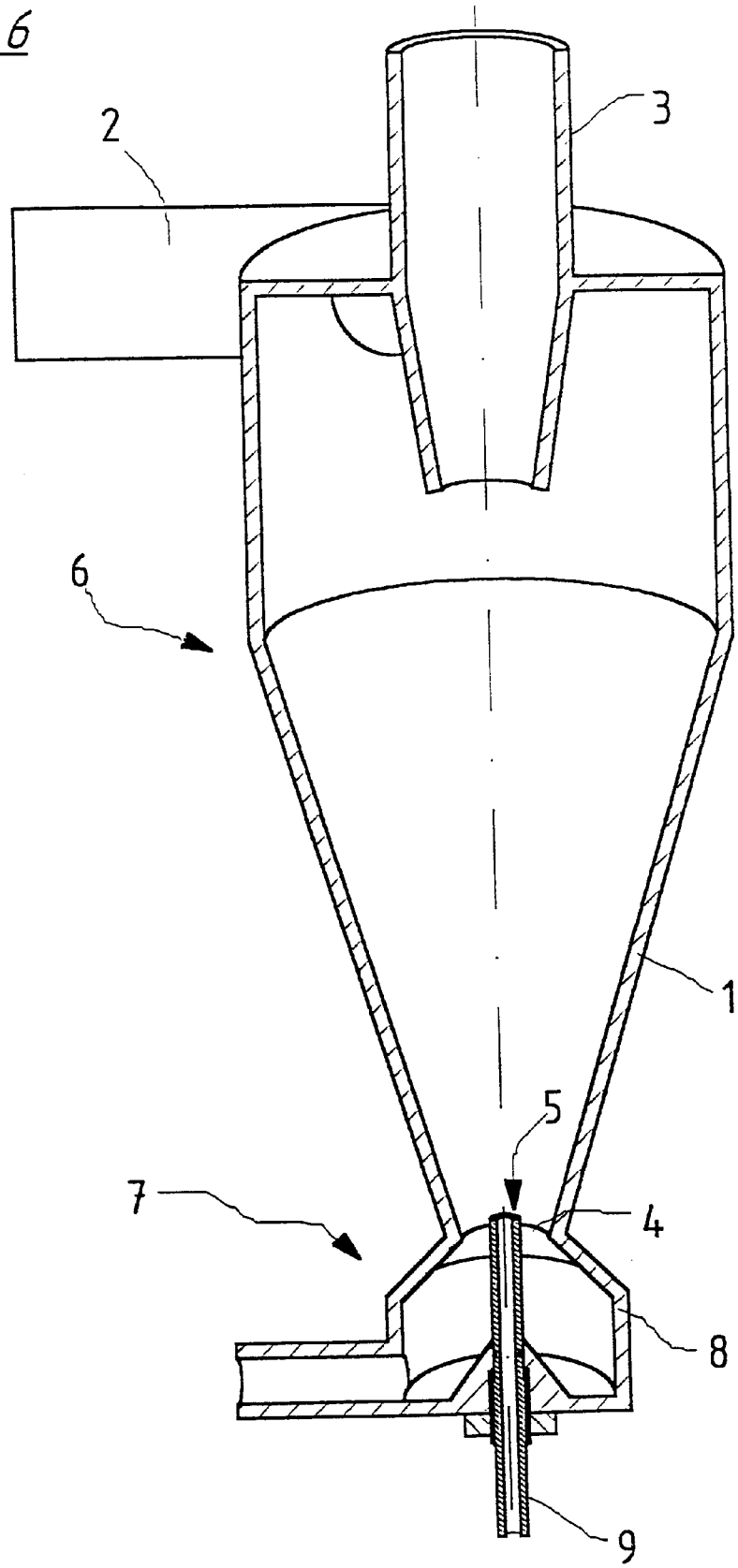
FIG. 6 shows a perspective view of a hydrocyclone according to the invention.
Figure 7:
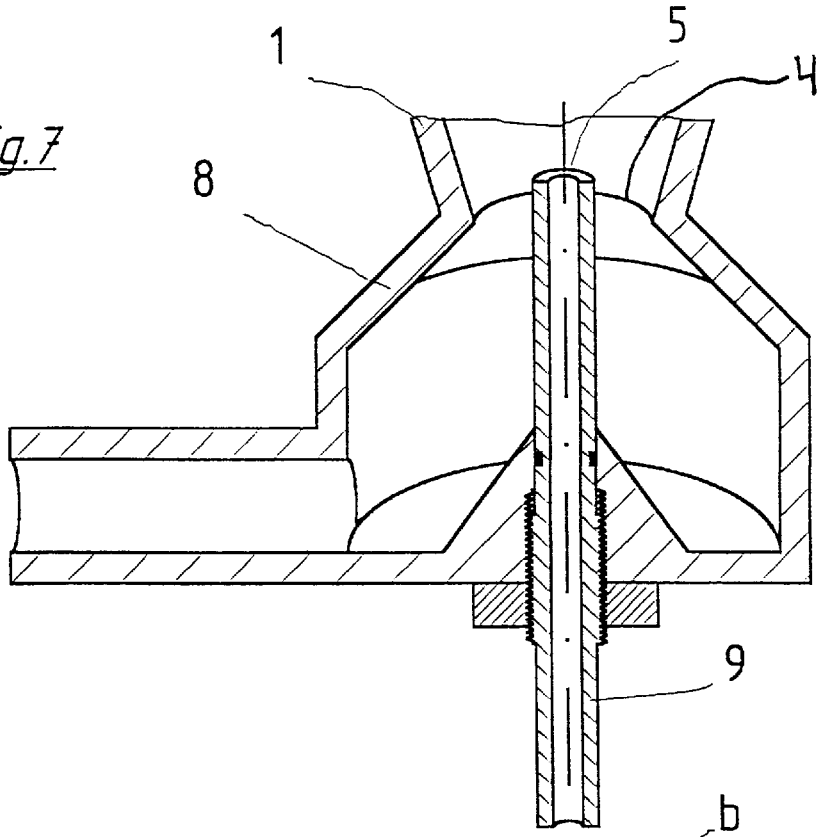
FIGS. 7–8 each show another variant of the lower part of the hydrocyclone according to the invention.

FIG. 6 shows a hydrocyclone which is similar to the device shown in FIG. 1 in a perspective view. Moreover, FIG. 7 essentially shows the lower part of FIG. 6 in enlarged form. This design utilizes inflow pipe 9 which is screwed in at the precise center and opens in a circular aperture above narrowest point 4. Accordingly, this design allows for ease of installation as well as adjustable axial displacement. Furthermore, utilizing this adjustable axial displacement design makes it possible to match the hydrocyclone to the conditions required.

Figure 8:
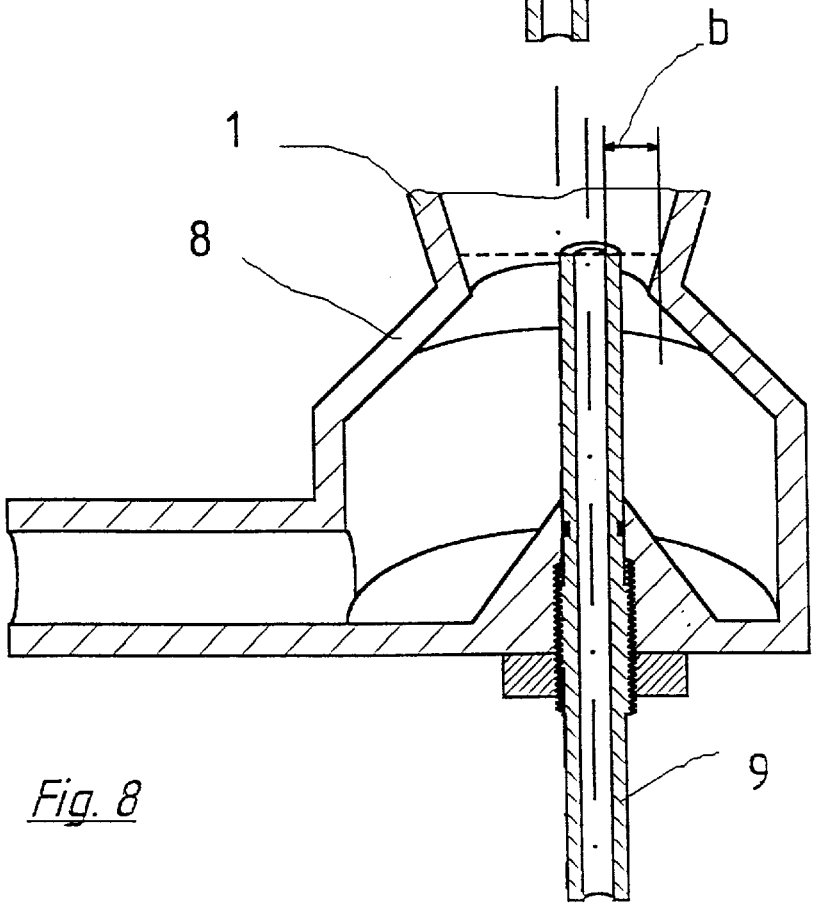

Another embodiment of the invention is shown in FIG. 8 which utilizes a discharge chamber 8 that exhibits a slightly eccentrically located inflow pipe 9. However, even in this design, it remains in the radially inner area of the hydrocyclone. Moreover, the outflow cross section of inflow pipe 9 maintains a distance "b" from the wall of the hydrocyclone. Accordingly, this distance may be at least approximately 10% of the inside diameter of the hydrocyclone at this point so as to ensure that the heavy parts that have already been concentrated are no longer washed by the diluting liquid. The eccentricity can also provide advantages in specific cases, e.g., such as when the hydrocyclone is operated horizontally. Moreover, its eccentric position can also be made adjustable.

Depending on the manner in which the flow insert 16, 16', or 16" is designed, the effects may vary when the process is carried out. These various effects may be extremely desirable as a rule. In fact, it is possible to achieve a specific optimization of the process depending on the application, i.e., throughput, stock density, and dirt load, to mention only a few. In practice, a considerable advantage is obtained when the various flow inserts are designed so that they can be exchanged. Such as design also makes it possible to match them to the conditions without great expense, namely by simply exchanging the variously designed flow inserts. In any case, practical maintenance considerations can dictate that the flow inserts be easily removable, because it is not always possible to avoid some clogging, in spite of all efforts to prevent them.

The flow inserts described in the figures are only intended to show the principle. Other flow insert designs are also contemplated. In particular, their dimensions and/or configurations can be matched to the respective application by calculations and/or simple testing.

It is noted that the foregoing examples have been provided merely for the purpose of explanation and are in no way to be construed as limiting of the present invention. While the present invention has been described with reference to an exemplary embodiment, it is understood that the words which have been used herein are words of description and illustration, rather than words of limitation. Changes may be made, within the purview of the appended claims, as presently stated and as amended, without departing from the scope and spirit of the present invention in its aspects. Although the present invention has been described herein with reference to particular means, materials and embodiments, the present invention is not intended to be limited to the particulars disclosed herein; rather, the present inventiun extends to all functionally equivalent structures, methods and uses, such as are within the scope of the appended claims.

What is claimed is:

1. A process for discharging impurities from a suspension containing paper fibers using a hydrocyclone comprising a radially inner area, the process comprising:

adding a diluting liquid into the suspension in the radially inner area of the hydrocyclone, wherein the diluting liquid is added in a flow direction opposite to an axial discharge direction of the impurities, and wherein the diluting liquid is added via at least one aperture whose position is adjustable.

2. The process of claim 1, wherein the hydrocyclone comprises a separating cone having a narrowest point and an addition point wherein the diluting liquid is added.

3. The process of claim 2, wherein the addition point is axially displaced from the narrowest point by a distance "a".

4. The process of claim 3, wherein the distance "a" comprises an axial length which is no greater than approximately 30% of an axial length of the hydrocyclone.

5. The process of claim 1, wherein the adding comprises adding a flow of the diluting liquid without swirl.

6. The process of claim 1, wherein the adding comprises adding a flow of the diluting liquid with only a swirl whose resulting flow rate vector is defined by a peripheral speed (Vu) and axial speed (Vax) at an edge of a jet, the resulting flow rate vector having an angle ($\alpha$) relative to an axial axis of no greater than approximately 30°.

7. The process of claim 1, wherein the adding comprises adding the diluting liquid via a smooth jet.

8. The process of claim 1, wherein the adding comprises adding the diluting liquid via a round jet.

9. The process of claim 1, wherein the adding comprises adding the diluting liquid via a ring-shaped jet.

10. The process of claim 1, wherein the adding comprises adding the diluting liquid into a center portion of the radially inner area with the aid of an injector, the injector drawing in liquid from a ring-shaped area around an addition point.

11. The process of claim 1, wherein the adding comprises adding the diluting liquid at an axial speed of at least approximately 4 m/s.

12. The process of claim 1, further comprising forming a light fraction from the suspension containing paper fibers, the light fraction comprising an accepted stock.

13. The process of claim 12, further comprising separating out a heavy fraction from the suspension, the heavy fraction comprising heavy parts.

14. A process for discharging impurities from a suspension containing paper fibers using a hydrocyclone comprising a radially inner area, the process comprising:

adding a diluting liquid into the suspension in the radially inner area of the hydrocyclone, the diluting liquid being added in a flow direction opposite to an axial discharge direction of the impurities, wherein the adding comprises adding a flow of the diluting liquid with only a swirl whose resulting flow rate vector is defined by a peripheral speed (Vu) and axial speed (Vax) at an edge of a jet, the resulting flow rate vector having an angle ($\alpha$) relative to an axial axis of no greater than approximately 30°.

15. A process for discharging impurities from a suspension containing paper fibers using a hydrocyclone comprising a radially inner area, the process comprising:

adding a diluting liquid into the suspension in the radially inner area of the hydrocyclone, the diluting liquid being added in a flow direction opposite to an axial discharge direction of the impurities, wherein the adding comprises adding the diluting liquid via a ring-shaped jet.

16. A process for discharging impurities from a suspension containing paper fibers using a hydrocyclone comprising a radially inner area, the process comprising:

adding a diluting liquid into the suspension in the radially inner area of the hydrocyclone, the diluting liquid being added in a flow direction opposite to an axial discharge direction of the impurities, wherein the adding comprises adding the diluting liquid into a center portion of the radially inner area with the aid of an injector, the injector drawing in liquid from a ring-shaped area around an addition point.

17. A process for discharging impurities from a suspension containing paper fibers using a hydrocyclone comprising a radially inner area, the process comprising:

adding a diluting liquid into the suspension in the radially inner area of the hydrocyclone, the diluting liquid being added in a flow direction opposite to an axial discharge direction of the impurities, wherein the adding comprises adding the diluting liquid at an axial speed of at least approximately 4 m/s.

18. A process for discharging impurities from a suspension containing paper fibers using a hydrocyclone which includes a separating cone having a narrowest point and an addition point disposed in an area of the narrowest point, the process comprising:

adding the diluting liquid into the suspension via the addition point, wherein the diluting liquid is added without swirl in a flow direction opposite to an axial discharge direction of the impurities.

19. A process for discharging impurities from a suspension containing paper fibers using a hydrocyclone which includes a separating cone having a narrowest point and an addition point disposed within the separating cone, the process comprising:

adding the diluting liquid into the suspension via the addition point, wherein the diluting liquid is added without swirl in a flow direction opposite to an axial discharge direction of the impurities.

20. A process for discharging impurities from a suspension containing paper fibers using a hydrocyclone which includes a separating cone having a narrowest point and an addition point adjustably positioned in the separation cone, the process comprising:

adding the diluting liquid into the suspension via the addition point, wherein the diluting liquid is added without swirl in a flow direction opposite to an axial discharge direction of the impurities.

21. A hydrocyclone for discharging impurities from a suspension containing paper fibers, the hydrocyclone comprising:

an inflow for introducing the suspension to be purified;

an accepted stock outflow for discharging the purified suspension;

a separating part;

a reject discharge device for discharging impurities of the suspension;

at least one element for adding a diluting liquid at an addition point which is located in a radially inner area of the hydrocyclone, the at least one element having at least one aperture opening axially and opposite to a discharge direction of the impurities, wherein the position of the at least one aperture is adjustable.

22. The hydrocyclone of claim 21, wherein the reject discharge device is directly attached to the separating part.

23. The hydrocyclone of claim 21, wherein the reject discharge device is indirectly attached to the separating part.

24. The hydrocyclone of claim 21, wherein the addition point is located away from the inflow at a point which is at least approximately 70% of an axial length of the hydrocyclone.

25. The hydrocyclone of claim 24, wherein the separating part comprises a separating cone.

26. The hydrocyclone of claim 21, wherein the addition point is disposed on part of a flow insert which is located inside the hydrocyclone.

27. The hydrocyclone of claim 26, wherein the flow insert is removable.

28. The hydrocyclone of claim 27, wherein the hydrocyclone is adapted to accept different flow inserts having different flow actions.

29. The hydrocyclone of claim 21, wherein the at least one aperture comprises an adjustable cross section.

30. The hydrocyclone of claim 21, wherein the addition point is arranged to be concentric with respect to a center of the hydrocyclone.

31. The hydrocyclone of claim 21, wherein the addition point is arranged to be eccentric with respect to a center of the hydrocyclone.

32. The hydrocyclone of claim 31, wherein the addition point is located at a distance from an inside wall of the hydrocyclone, the distance being at least approximately 10% of an adjacent inside diameter of the hydrocyclone.

33. The hydrocyclone of claim 21, wherein the addition point comprises a mouth end of an inflow pipe which is introduced into the hydrocyclone at a position which is below a narrowest cross section portion of the separating part.

34. A hydrocyclone for discharging impurities from a suspension containing paper fibers, the hydrocyclone comprising:

an inflow for introducing the suspension to be purified;

an accepted stock outflow for discharging the purified suspension;

a separating part;

a reject discharge device for discharging impurities of the suspension;

at least one element for adding a diluting liquid at an addition point which is located in a radially inner area of the hydrocyclone, the at least one element having at least one aperture opening axially and opposite to a discharge direction of the impurities, wherein the addition point is disposed on part of a flow insert which is located inside the hydrocyclone.

35. The hydrocyclone of claim 34, wherein the flow insert is removable.

36. The hydrocyclone of claim 35, wherein the hydrocyclone is adapted to accept different flow inserts having different flow actions.

37. A hydrocyclone for discharging impurities from a suspension containing paper fibers, the hydrocyclone comprising:

an inflow for introducing the suspension to be purified;

an accepted stock outflow for discharging the purified suspension;

a separating part;

a reject discharge device for discharging impurities of the suspension;

at least one element for adding a diluting liquid at an addition point which is located in a radially inner area of the hydrocyclone, the at least one element having at least one aperture opening axially and opposite to a discharge direction of the impurities, wherein the at least one aperture comprises an adjustable cross section.

38. A hydrocyclone for discharging impurities from a suspension containing paper fibers, the hydrocyclone comprising:

an inflow for introducing the suspension to be purified;

an accepted stock outflow for discharging the purified suspension;

a separating part;

a reject discharge device for discharging impurities of the suspension;

at least one element for adding a diluting liquid at an addition point which is located in a radially inner area of the hydrocyclone, the at least one element having at least one aperture opening axially and opposite to a discharge direction of the impurities, wherein the addition point is arranged to be eccentric with respect to a center of the hydrocyclone.

39. The hydrocyclone of claim 38, wherein the addition point is located at a distance from an inside wall of the hydrocyclone, the distance being at least approximately 10% of an adjacent inside diameter of the hydrocyclone.

40. A hydrocyclone for discharging impurities from a suspension containing paper fibers, the hydrocyclone comprising:

an inflow for introducing the suspension to be purified;

an accepted stock outflow for discharging the purified suspension;

a separating part;

a reject discharge device for discharging impurities of the suspension;

at least one element for adding a diluting liquid at an addition point which is located in a radially inner area of the hydrocyclone, the at least one element having at least one aperture opening axially and opposite to a discharge direction of the impurities, wherein the at least one aperture is adapted to add a flow of the diluting liquid without swirl.

* * * * *